United States Patent [19]

Kasuya et al.

[11] Patent Number: 4,514,487

[45] Date of Patent: Apr. 30, 1985

[54] METHOD FOR MANUFACTURING TONER FOR ELECTROPHOTOGRAPHY

[75] Inventors: Takahira Kasuya; Hideaki Morita; Hiroyuki Takagiwa; Goichi Yamakawa, all of Hachioji, Japan

[73] Assignee: Konishiroku Photo Industry Co., Ltd., Tokyo, Japan

[21] Appl. No.: 484,692

[22] Filed: Apr. 14, 1983

Related U.S. Application Data

[63] Continuation of Ser. No. 215,416, Dec. 11, 1980, abandoned.

[30] Foreign Application Priority Data

Dec. 17, 1979 [JP] Japan ..... 54-162843

[51] Int. Cl.[3] ..... G03G 9/08

[52] U.S. Cl. ..... 430/137; 430/126; 524/803

[58] Field of Search ..... 430/137, 110, 96, 126

[56] References Cited

U.S. PATENT DOCUMENTS

| | | | |
|---|---|---|---|
| 3,558,492 | 1/1971 | Proskow | 430/107 |
| 3,634,251 | 1/1972 | Maeda et al. | 430/137 |
| 3,959,153 | 5/1976 | Sadamatsu et al. | 430/109 X |
| 3,983,045 | 9/1976 | Jugle et al. | 430/110 |
| 4,071,670 | 1/1978 | Vanzo | 260/42.53 |
| 4,077,804 | 3/1978 | Vanzo | 430/137 |
| 4,231,919 | 11/1980 | Isaacson | 430/109 |

FOREIGN PATENT DOCUMENTS

| | | | |
|---|---|---|---|
| 2815093 | 10/1978 | Fed. Rep. of Germany | 430/111 |

*Primary Examiner*—John D. Welsh
*Attorney, Agent, or Firm*—Jordan B. Bierman

[57] ABSTRACT

A method for manufacturing a toner for use in electrophotography comprising polymerizing a monomer to provide the polymer constituent of the toner in the presence of both a coloring agent and an anti-offset agent. Specific anti-offset agents are set forth and the toner made by the foregoing process is also disclosed.

10 Claims, No Drawings

METHOD FOR MANUFACTURING TONER FOR ELECTROPHOTOGRAPHY

This application is a continuation of application Ser. No. 215,416, filed Dec. 11, 1980 abandoned, which in turn, claims the benefit of the priority of Japanese Application No. 162843/79 filed Dec. 17, 1979.

The present invention relates to a manufacturing method of toner that is used to develop electrostatic latent images formed by electrophotography, electrostatic printing, electrostatic recording, etc.

Generally, the latent electrostatic image formed on a photoconductive material used in electrophotography is developed by using toner. The resultant toner image must be transferred onto and finally fixed on a support for the toner image such as the copy paper. Various fixing methods of the toner image are heretofore known. Among them heat fixing method is advantageous in practical respects, and particularly, contact type heat fixing method employing a hot roller fixing unit, etc. is considered to be preferable for its high thermal efficiency with a heat source having relatively low temperature and thus, for example even in the case of such a trouble when a copy paper is jammed in the fixing region of a paper conveying system the danger of catching fire can be minimized.

However, in the contact type heat fixing method, the surface of a heating body such as a hot roller has to be in contact with toner to fuse it for fixing, so this method is liable to cause a trouble so-called offset phenomenon in which fused toner or a part of half-fused toner sticks to the surface of heating body and thus stuck toner is liable to be transferred to copy papers that thereafter come in contact with it. This offset phenomenon often occurs when the viscoelasticity of the heated and fused toner is not appropriate and, especially, when the viscoelasticity is too low.

To prevent the offset phenomenon as mentioned above, it is of course preferable that toner itself has such as characteristic that prevents any offet phenomenon. As a method to obtain such offset-free toner, it is known to mix a polymer that is a constituent of toner with an anti-offset agent together with other constituents of the toner such as a coloring agent. In the conventional method of toner preparation, however, it is very difficult to prepare toner that contains an anti-offset agent in a favorable condition.

Namely, in the prior art, a polymer, coloring agent, anti-offset agent and other necessary toner constituents are premixed and then heated to fuse the polymer. The mixture is then kneaded to give a lump, which is thereafter crushed and pulverized to form toner in the form of powder having desirable particle size.

However, in this known method, the polymer still shows high viscosity even when it is fused during the fusing and kneading step, and further since the viscosity of the anti-offset agent in the fused state differs much from that of the polymer, so these two components are practically very slightly intermiscible with each other. Thus, a very rigorous condition is required in the fusing and kneading step and yet uniform dispersion of the anti-offset agent in the polymer may not be obtained. As a result, to obtain offset-free toner of practical use, it is necessary for individual toner particles to contain excess amount of such anti-offset agent. However, the addition of excess amount of anti-offset agent lowers the fluidity of toner powder to cause various difficulties in image development and toner handling. Also the toner with surplus anti-offset agent, when used for development, often causes toner filming on an electrostatic latent image-carrying surface (e.g., a photoconductor in the case of electrophotography) to deteriorate the image quality. A possible approach to improve the dispersed condition of the anti-offset agent may be to prolong kneading step. However, to prolong kneading impairs the polymer in its desirable performances. For example, molecular chains of the polymer are liable to be cut by shearing forces produced during the kneading operation, which reduces the molecular weight of the polymer and deteriorates the polymer in its offset-free performance. This approach thus ends only in a complication of the manufacturing process and the expected effect cannot be achieved by it.

Therefore, it is an object of the present invention to remove disadvantages of the conventional method and thereby provide a method for manufacturing toner for electrophotographic use, by which method an anti-offset agent and other additives such as a coloring agent can be dispersed satisfactorily and thereby to give toner in which toner particles contain these agents in the uniform state.

The above-mentioned object of the present invention can be achieved by a method which involves a step in which a monomer to give a polymer constituent of toner is polymerized in the presence of an anti-offset agent.

More preferably, in the present invention, an anti-offset agent and a coloring agent, if necessary together with other toner constituents, for example, a charge control agent are added to a monomer, which can give a polymer constituent by polymerization, and the mixture is then dispersed or dissolved to provide a composition. The composition is then put to a condition under which polymerization is initiated to give a solid polymerized particles in which the anti-offset agent as well as coloring agent and other additives are uniformly incorporated can be obtained. This solid particles may be crushed and pulverized, if necessary, into particles having sizes suitable for toner, i.e. 1 to 50 microns in diameter.

According to the present invention as the method for polymerizing said monomer any conventional method such as addition polymerization (solution polymerization, suspension polymerization, and bulk polymerization), condensation polymerization, and other polymerization methods may be properly selected and used. If the selected polymerization reaction requires a polymerization initiator and/or catalyst, such unitiator and/or catalyst may be added to the composition.

If the solid material obtained by the polymerization is in a form of solid lump or particles larger than desirable sizes for toner, then it will be necessary to crush and pulverize the polymerization product, however, by properly selecting polymerization method or conditions it will be possible to obtain polymerization product in a form of particles having required sizes for toner, where such crushing and pulverizing step is not necessary.

In the present invention, as the monomer which gives a polymer constituent for the toner by addition copolymerization, monoolefin and diolefin monomers may be mentioned as preferable monomers. As examples of the monoolefin monomers styrenes including styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene; ethylenic unsaturated monoolefins including ethylene, propylene, butylene, and isobutylene; vinyl halides including vinyl chloride, vinylidene chloride, vinyl bromide, and vinyl floride; vinyl esters including vinyl acetate, vinyl propionate, vinyl benzoate, and vinyl butyrate; esters of α-methylene aliphatic monocarboxylic acids including methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, and diethylaminoethyl methacrylate; derivatives of acrylic and methacrylic acids including acrylonitrile, methacrylonitrile, and acrylamide; vinyl ethers including vinyl methyl ether, vinyl ethyl ether, and vinyl isobutyl ether; vinyl ketones including vinyl methyl ketone, vinyl hexyl ketone, methyl isopropenyl ketone; N-vinyl compounds including N-vinylpyrrole, N-vinylcarbazole, N-vinylindole, and N-vinylpyrrolidone; and vinyl naphthalenes can be mentioned.

Further, as examples of the diolefin monomers propadiene, butadiene, isoprene, chloroprene, pentadiene, and hexadiene can be mentioned.

These monomers may be used either singly or in combination of two or more, or they may be used in combination to form a copolymer after polymerization.

Further in the present invention as for the monomers that undergo a condensation polymerization to form the polymer constituent, the combination of polyalcohols and polycarboxylic acids which gives polyesters and the combination of polyamines and polycarboxylic acids which gives polyamides may be mentioned. In the above, as examples of the polyalcohol, ethylene glycol, triethylene glycol, 1,2-propylene glycol, 1,3-propylene glycol, 1,4-butanediol, neopentyl glycol, 1,4-butenediol, 1,4-bis(hydroxymethyl)cyclohexane, bisphenol A, hydrogenated bisphenol A, polyoxyethylene derivative of bisphenol A, and polyoxypropylene derivative of bisphenol A can be mentioned. As examples of the polyamine, ethylenediamine, tetramethylenediamine, pentamethylenediamine, piperazine, and hexamethylenediamine can be mentioned. Further, as examples of the polycarboxylic acid, maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, and anhydrides thereof, esters derived from reaction with lower alcohols, and dimer of linoleic acid can be mentioned.

In the method of the present invention, as the anti-offset agent polyolefins having average molecular weight of 1000 to 45000 may be preferably used. It is preferable that polyolefins which are highly intermiscible with the aforementioned monomer and the polymer prepared therefrom are used. Further, the use of a polyolefin that has a top high melting point is not desirable since it raises the fusing temperature of the resultant toner. Therefore, in the present invention polyolefins having lower molecular weight are preferable as the anti-offset agent. An ether-extractable polyolefin of weight average molecular weight between about 1000 and 45000 and particularly between about 2000 and 6000 is thus preferably used for this purpose.

Further, among these polyolefins those having softening point of between 100° C. and 180° C. and more preferably between 130° C. and 160° C. can be mentioned to be more advantageous.

Examples of preferable polyolefin are polyethylene, polypropylene, and polybutylene, among which polypropylene is most preferable.

Further, in the present invention, polyolefins that may be effectively used as the anti-offset agent include olefin copolymers of low molecular weight. They are olefin copolymers of lower molecular weight that are composed either of only olefin monomers or of olefin and non-olefin monomers.

Examples of the olefin monomers are ethylene, propylene, butene-1, pentene-1, hexene-1, heptene-1, octene-1, nonene-1, decene-1 or isomers thereof, alkylated derivatives of the above monomers, such as 3-methyl-1-butene, 3-methyl-2-pentene and 3-propyl-5-methyl-2-hexene, and all other olefins.

Further, examples of the non-olefin monomer that is used for copolymerization with an olefin monomer include vinyl ethers such as vinyl methyl ether, vinyl n-butyl ether, and vinyl phenyl ether; vinyl esters such as vinyl acetate, and vinyl butyrate; haloolefins such as vinyl fluoride, vinylidene fluoride, tetrafluoroethylene, vinyl chloride, vinylidene chloride and tetrachloroethylene; acrylic or methacrylic esters such as methyl acrylate, ethyl acrylate, n-butyl acrylate, methyl methacrylate, ethyl methacrylate, n-butyl methacrylate, stearyl methacrylate, N,N-dimethylaminoethyl methacrylate, and t-butylaminoethyl methacrylate; acrylic acid derivatives such as acrylonitrile, and N,N-dimethylacrylamide; organic acids such as acrylic acid, methacrylic acid, maleic acid, fumaric acid, and itaconic acid; dimethyl fumarate and β-pinene.

Therefore, olefin copolymers of low molecular weight that can be used as the anti-offset agent in the present invention are either olefin copolymers that are composed or two or more different olefin monomers as above cited or the ones that are composed of at least one of the above cited olefin monomers and at least one of the above cited non-olefin monomers. Examples of the former type of olefin copolymer are ethylene/propylene copolymers, ethylene/butene copolymer, ethylene/pentene copolymer, propylene/butene copolymer, propylene/pentene copolymer, ethylene/3-methyl-1-butene copolymer, and ethylene/propylene copolymer, with examples of the latter type of olefin copolymer are ethylene/vinyl acetate copolymer, ethylene/vinyl methyl ether copolymer, ethylene/vinyl chloride copolymer, ethylene/methyl acrylate copolymer, ethylene/methyl methacrylate copolymer, ethylene/acrylic acid copolymer, propylene/vinyl acetate copolymer, propylene/vinyl ethyl ether copolymer, propylene/ethyl acrylate copolymer, propylene/methacrylate copolymer, butene/vinyl methyl ether copolymer, betene/methyl methacrylate copolymer, pentene/vinyl acetate copolymer, hexene/vinyl butyrate copolymer, ethylene/propylene/vinyl acetate copolymer, and ethylene/vinyl acetate/vinyl methyl ether copolymer.

Among olefin copolymers of low molecular weight that contain one or more non-olefin monomers, those that contain the olefin monomer constituent in a higher proportion are preferred. This is because olefin copolymers containing non-olefin monomer or monomers have a general tendency that the less is the olefin content in an olefin copolymer, the poorer its non-offsetting performance becomes. Further these copolymers tend to lower the fluidity and deteriorate image-forming performance of the resultant toner. Particularly, copolymers whose olefin content exceeds about 50 mol% are preferably used for the anti-offset agent in the present invention.

It is noted that if a polyolefin of weight average molecular weight of 1000 or less is used, the softening point of the resultant toner is often lowered and toner particles are liable to coagulate, and at the same time the photoconductor or carrier tends to be heavily soiled when the toner is used in electrophotography. On the other hand when the weight average molecular weight exceeds 45000, the softening point of the resultant toner tends to rise too high for the effective anti-offset performance of toner.

In the present invention, to 100 parts by weight of the monomer constituent of the composition for polymerization, 1 to 10 parts by weight and preferably 2 to 5 parts by weight of the polyolefin anti-offset agent may advantageously be added. If less than 1 part by weight is added, less satisfactory and positive anti-offset effect may be expected while the use of more than 10 parts by weight will adversely affect the charging performance and fluidity of the resultant toner.

In addition to the polyolefins as mentioned above, the following compounds can be cited as the anti-offset agent that can be effectively used in the present invention: metal salts of fatty acids including zinc, barium, lead, cobalt, calcium and magnesium stearates, zinc, manganese, iron and lead oleates, and zinc, cobalt and magnesium palmitates; higher fatty acids containing 17 or more carbon atoms, as well as higher alcohols; esters of polyhydric alcohols; natural or synthetic paraffins; esters of fatty acids and partially saponified derivatives of these esters; alkylene bis-fatty acid amides including ethylenebisstearoylamide; aliphatic fluorocarbon compounds; silicon varnish; oligomers of stearylacrylate; oligomers of copolymers containing stearylacrylate, etc. Two or more of these compounds may be used in combination. To 100 parts by weight of the monomer constituent of the composition for polymerization, generally about 0.1 to 10 parts by weight and preferably 0.5 to 5 parts by weight of the above type of anti-offset agent may be added.

These compounds may be used in combination with the aforementioned polyolefins, when the resultant toner is not only given the necessary offset-free nature but made stiffer even in case the polymer is comparatively brittle. As a result, when the crushing and pulverizing step is performed, the production of ultrafine particles is suppressed, so toner having desirable particle sizes may be obtained at a high yield. Further, the resultant toner is stabilized in performances to stand prolonged use without deterioration in the friction charging performance. Thus, toner of very long service life becomes available. Besides, if the aforementioned compounds are insoluble in water, the resultant toner will acquire the desirable moistureproof property.

In the present invention, a suitable pigment or dye may be used as a coloring agent of toner. Examples of the suitable pigment or dye include carbon black, nigrosine dye (C.I. No. 50415B), aniline blue (C.I. No. 50405), chalco oil blue (C.I. No. azoec blue 3), chrome yellow (C.I. No. 14090), ultramarine blue (C.I. No. 77103), Du Pont oil red (C.I. No. 26105), orient oil red #330 (C.I. No. 60505), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266), and rose bengale (C.I. No. 45435). They may be used singly or in combination.

In the above described method of the present invention, the anti-offset agent is contained in the toner constituent polymer in a very completely and uniformly dispersed state. This is because when the composition for polymerization undergoes the polymerization step, its monomer constituent that forms one of the aforementioned polymers is already mixed with the anti-offset agent, namely, the anti-offset agent is added and mixed while such monomer constituent has not yet completed its polymerization and therefore it is still in a liquid state. In other words, if the monomer constituent itself is in a liquid state (or in a dissolved state), the anti-offset agent can be dispersed fully uniformly in the corresponding monomer constituent, so on completion of polymerization a desirable state is achieved in which molecules of the anti-offset agent are dispersed between molecular chains of polymer formed. Further, even when the monomer constituent is given in a solid state, it is liquefied though temporarily as the polymerization reaction proceeds, and the anti-offset agent is then dispersed fully uniformly in the monomer constituent, resulting in the same desirable state as in the case of liquid monomer constituent on completion of polymerization. Further, in the above polymerization step, since the reaction mixture is usually heated, the anti-offset agent is sometimes melted by aborbing heat or dissolved in the monomer constituent to positively achieve the uniform dispersion in it. As a result, toner is made available which contains the anti-offset agent in a state very uniformly dispersed or mixed in the polymer formed.

As a result of the above, individual toner particles prepared will positively contain the anti-offset agent to assure the offset-free performance of toner while it becomes no more necessary to use an excess amount of the anti-offset agent, so toner is free from the poor fluidity that may be caused by a surplus anti-offset agent content and when such toner is used in electrophotography, toner filming on the photoconductor may be avoided, assuring the good reproduction of the original image.

In the present invention, the above effects may be achieved if the composition for polymerization contains the monomer constituent and anti-offset agent. Further, if a coloring agent that is necessary for a toner constituent is brought in the composition for polymerization, as in the actual example of the method already described, toner is made available in which the coloring agent is likewise uniformly dispersed in the polymer mass. The fusing and kneading step is then no more required. Simplifying the preparation process remarkably and saving the cost. At the same time, the deterioration of the polymer in its characteristic performances due to the kneading operation may be completely avoided. Further, in this case, if a polymerization method is adopted by which the polymerization product is given in a powdery form whose particles are sized between 1 and 50$\mu$ satisfying the requirement for toner, the crushing and pulverizing step becomes also unnecessary, so the end product toner may be directly prepared.

Both the coloring agent and anti-offset agent may be preferably added to the composition for polymerization as in the above example. In the present invention, however, it is also possible to use a composition for polymerization composed only of a monomer constituent and anti-offset agent at the polymerization step and then fuse and knead the resultant polymer mass together with a coloring agent, the kneaded mixture being subjected to a crushing and pulverizing step to prepare toner. In this case, though the fusing and kneading step is needed, the polymer mass to be treated at this step already contains the anti-offset agent uniformly, so that step no more requires any rigorous condition. Thus, toner that has necessary characteristic properties can be prepared positively in a drastically favorable condition as compared to the conventional method.

It is a matter of course that the present invention can be applied not only to a type of toner that is combined with carrier to form developer, which is so-called two-component type developer but also to magnetic toner that contains magnetic powder dispersed therein, which is often called as one-component type developer.

The magnetic powder in case of the magnetic toner or other substances that must be added as toner constituents, for example, a charge control agent may be added either to the composition for polymerization or to the polymerized composition at the fusing and kneading step.

As stated, above, according to the present invention, the anti-offset agent is uniformly contained in polymer particles and, therefore, it is possible to prepare toner for the development of latent electrostatic images that has an effective offset-free property. As for the offset-free property of toner, there is one important factor to be considered for giving the toner necessary offset-free property. And this is the elasticity exhibited by the constituent polymer itself of the toner at the time of its fusing. As an approach to give a large elasticity to a polymer at the time of its fusing, it is practised to increase the molecular weight of polymer or cross-link polymer molecules to more entangle molecular chains. However, a polymer whose molecular weight is increased enough or whose molecules are cross-linked enough to give an effective anti-offset property generally has a high softening point, showing high stiffness, so it has a demerit that when it is used in preparing toner, a large energy is consumed at the crushing and pulverizing step and also at the fixing step after development.

However, if the polymer has a wide molecular weight, distribution in which a low molecular weight fraction and high molecular weight fraction or cross-linked fraction exist in the same polymer, the low molecular weight fraction will function to assure the fixing performance and crushability while the high molecular weight or cross-linked fraction will function to give the toner the offset-free property. These characteristic properties can be obtained to toner simultaneously if its constituent polymer has a ratio of the weight average molecular weight Mw to the number average molecular weight Mn (Mw/Mn) equivalent to 3.5 or more.

In the present invention, therefore, the constituent polymer of the end product toner preferably has a Mw/Mn value equivalent to 3.5 or more. For this purpose, the composition for polymerization may be subjected to polymerization after addition of a cross-linking agent for its monomer, or such monomer may also be polymerized in the presence of a polymer.

The cross-linking aget used for this purpose is selected primarily from a compound having in its molecule a plurality of double bonds that can undergo a polymerization reaction when the monomer is a monoolefin or diolefin. Examples of such cross-linking agent include aromatic divinyl compounds such as divinylbenzene, divinylnaphthalene and their derivatives; diethylenic carboxylic acid esters such as diethylene glycol methacrylate, diethylene glycol acrylate, triethylene glycol methacrylate, trimethylolpropane trimethacrylate, aryl methacrylate, t-butylaminoethyl methacrylate, tetraethylene glycol dimethacrylate, and 1,3-butanediol dimethacrylate; divinyl compounds such as N,N-divinylaniline, divinyl ether, divinyl sulfide and divinyl sulfone; and compounds whose molecule contain three or more vinyl groups. They may be used singly or in combination.

The cross-linking agent as cited above may be added at the proportion of 0.01 wt% or more, and preferably, 20 wt% or less on the basis of such monomer in the composition for polymerization to obtain constituent polymer having a Mw/Mn value equivalent to 3.5 or more.

When the aforementioned monomer constituent is selected from a combination of a polyalcohol or polyamine and polycarboxylic acid, a polyalcohol having more than three hydroxyl groups or a polyamine having more than three amino groups and a polycarboxylic acid having more than three carboxylic acid groups may preferably be used as an effective cross-linking agent. Examples of such polyalcohol include glycerin, trimethylolpropane, and pentaerythritol. Examples of polyamine include 1,2,3-triaminopropane, diethylenetriamine, and 3,3-diaminobenzidine. Further, examples of the polycarboxylic acid include trimellitic acid and pyromellitic acid. The cross-linking agent as cited above may be added at the proportion of 0.1 mol% or more and preferably 5 mol% or less on the basis of a monomer used in the composition for polymerization in order to obtain desirable toner comprising such polymer having Mw/Mn value equivalent to 3.5 or more.

In the case that the monomer is polymerized in presence of a polymer, the monomer can be polymerized either in the presence of a high molecular weight polymer while the monomer itself give a polymer of lower molecular weight or in the presence of a low molecular weight polymer, while the monomer giving a polymer of higher molecular weight. The Mw/Mn value of the composite polymer product obtained in this way depends on the degree of polymerization of the polymer initially added and its proportion to the monomer constituent, but the Mw/Mn value equivalent to 3.5 or more can be achieved if the final composite polymer product contains a polymer fraction of low molecular weight less than 100,000 and high molecular weight fraction of more than 100,000 at the proportion of 5 or more parts by weight based on 100 parts by weight of the low molecular weight fraction.

The parameters Mw, Mn and Mw/Mn can be determined by various methods and their value depends somewhat on the measuring method used. In this invention, Mw/Mn is determined by the following method.

Namely, all of these parameters were determined by the gel permeation chromatography under a condition as described below. Solvent tetrahydrofuran was passed at a flow rate of 1 ml/min at 25° C. while the test sample was dissolved in tetrahydrofuran at a concentration of 0.4 g/dl and a volume of the resultant solution corresponding to 8 mg of test sample was injected for a measurement. In the molecular weight measurement with the test samples, a measuring condition was so selected that the distribution of molecular weights of the test sample was covered by the linear range of a calibration curve drawn by plotting the logarithm of molecular weight versus the count with use of several standard polystyrene samples of simple molecular weight dispersion. The reliability of the above measurement was confirmed by measuring the parameters Mw and Mn of a standard polystyrene NBS 706 ($Mw=288\times10^4$, $Mn=13.7\times10^4$, and $Mw/Mn=2.11$) to see $Mw/Mn=2.11\pm0.10$.

Further, in the present invention, the anti-offset agent, coloring agent, etc. may be added in a higher proportion on the basis of the monomer constituent in the composition for polymerization to obtain a polymer that contains these agents at a higher concentration. This concentrated toner composition is fused and kneaded with an ordinarily usable polymer as the toner constituent to achieve the necessary dilution of the such additives in the toner.

The present invention is further illustrated with reference to the following examples. In the following Examples it is noted that the phrase "parts by weight" will hereinafter be abbreviated as "parts" unless otherwise specified.

EXAMPLE 1

| | |
|---|---|
| Styrene | 70 parts |
| n-butyl methacrylate | 30 parts |
| Benzoyl peroxide | 1 part |
| Carbon black | 5 parts |
| Low molecular weight polyethylene "6A" (produced by Allied Chemical) | 5 parts |

The above compounds were mixed and ground by a sand grinder for dispersion to obtain a composition for polymerization in which the carbon black was satisfactorily dispersed. The composition for polymerization was introduced in a 3-mouthed flask of 1 liter in capacity filled with distilled water containing 0.6 wt% of polyvinyl alcohol. After mixing and dispersion being obtained, the gaseous phase was replaced with nitrogen gas and the reaction mixture was heated and kept at 80° C. for 10 hours to complete the polymerization. After cooling, the reaction product was repeatedly dehydrated and rinsed, and finally dried to give a solid material in a form of coarse particles. The material was then crushed and pulverized to provide the Toner Sample 1 whose mean particle size was approx. 13 to 15μ.

4 parts of Toner Sample 1 was mixed with 96 parts of iron powder carrier whose mean particle size was about 50 to 80μ to give developer. A latent electrostatic image formed by the conventional electrophotography was developed with this developer and the toner image thus formed was transformed to a copy paper. A fixing unit composed of a pair of rollers, i.e., the fixing roller whose surface is coated with teflon (polytetrafluoroethylene produced by Du Pont) and the pressure roller whose surface is coated with silicon rubber ("KE-1300 RTV" produced by Shinetsu Chemical Industry Co., Ltd.) was used for fixing. Namely, the linear velocity of the unit was set to 150 mm/sec and the temperature of the fixing roller was variously changed to process the above copy paper to fix the transferred toner image. To see if some toner was left to adhere to the surface of fixing roller and cause the offset phenomenon, a copy paper that carried no toner image was then passed across the fixing unit and checked for soiling, if any, due to the offset phenomenon.

In this test, a slight sign of soiling was detected when the temperature of fixing roller was raised to 200° C.

Further, a plain paper copier U-BiX V (produced by Konishiroku Photo Industry Co., Ltd.) was used with the temperature of fixing roller set to 180° C. to conduct a copy test with the above developer. In this test, clear copy images were obtained and even after 20000 copies, though the fixing roller was found somewhat soiled with toner, copy images were still free from soiling and further no soiling of the photoconductor with toner was detected at that time.

EXAMPLE 2

| | |
|---|---|
| Maleic acid | 25 parts |
| Terephthalic acid | 36 parts |
| Bisphenol A | 100 parts |
| "Orient Oil Red #330" (produced by Orient Co., Ltd.) | 10 parts |
| Low molecular weight polypropylene "Viscol 550 P" (produced by Sanyo chemical Industry) | 5 parts |

The above compounds were put into a 1-liter 4-mouthed flask and the gaseous phase was replaced with nitrogen gas. This reaction mixture was gradually heated on a mantle heater for about an hour until the temperature of the mixture came up to 150° to 160° C. and kept in this temperature range for another hour. The mixture was then heated and kept at 210° C. for polymerization while removing water formed by the esterification reaction. A part of the reaction mixture was sampled at intervals of about 10 to 15 min for the measurement of its acid value. When the acid value reached 4.0, the mixture was cooled down to 140° C. and hydroquinone was added to complete the polymerization. The solid material thus obtained was crushed and pulverized to prepare the Toner Sample 2 whose mean particle size was approx. 13 to 15μ.

The same offset test as in Example 1 was conducted but for the use of Toner Sample 2. A slight sign of soiling due to the offset phenomenon was only detected when the temperature of fixing roller was raised to 190° C. Further, the same copy test as in Example 1 was conducted, which also gave a favorable result similar to the one in Example 1.

EXAMPLE 3

The composition for polymerization as obtained in Example 1 was introduced in a 3-mouthed flask filled with distilled water containing 0.6 wt% of polyvinyl alcohol. After mixing to make dispersion, the gaseous phase was replaced with nitrogen gas and the reaction mixture was heated and kept at 80° C. for 15 hours to undergo the first stage of polymerization reaction. The temperature was then cooled down to 40° C. 100 parts of another composition for polymerization composed of the following mixture;

| | |
|---|---|
| Styrene | 70 parts |
| n-butyl methacrylate | 30 parts |
| Benzoyl peroxide | 1 part |
| Carbon black | 5 parts |
| α-methylstyrene | 5 parts |
| Low molecular weight polyethylene "6A" | 5 parts |

was added to 10 parts of the above composition that had undergone the first stage of polymerization and the mixture was agitated for 2 hours at 45° C. After 100 parts of distilled water containing 1.2 wt% of polyvinyl alcohol was added, the resultant suspension was heated and kept at 80° C. for 8 hours and then at 90° C. for 2 hours to complete the polymerization reaction. After cooling, dehydration and rinsing were repeated to obtain a solid material in a form of coarse particles, which was crushed and pulverized to prepare the Toner Sample 3.

The same offset test as in Example 1 was conducted but for the use of Toner Sample 3, in which no soiling due to the offset phenomenon was detected even when the temperature of fixing roller was raised up to 240° C. Further, in the same copy test as in Example 1, even after 40000 copies, neither the fixing roller nor the photoconductor showed any sign of soiling with toner and copy images obtained were good being as clear and soilless as those in the first copies. The polymer constituent was separated from this toner to determine its molecular weight by gel permeation chromatography. The results were $Mw=9\times10^4$, $Mn=1\times10^4$ and $Mw/Mn=9$.

EXAMPLE 4

The Toner Sample 4 was prepared just in the same manner as in Example 1 but for the use of a composition for polymerization that was prepared by adding 0.5 parts of divinyl benzene as a cross-linking agent to the formulation given in Example 1.

The same offset and copy tests as in Example 1 were conducted but for the use of Toner Sample 4. The results were as favorable as in Example 3. For the polymer constituent of this toner, the molecular weight was measured as in Example 3. The results were $Mw=28.9\times10^4$, $Mn=1.6\times10^4$ and $Mw/Mn=18.1$.

EXAMPLE 5

The Toner Sample 5 was prepared in the same manner as in Example 2 but for the use of a composition for polymerization that was prepared by adding 2 parts of pentaerythritol as a cross-linking agent to the formulation given in Example 2.

The same offset and copy tests as in Example 1 were conducted but for the use of Toner Sample 5. The results were as favorable as in Example 3. For the polymer constituent of this toner, the molecular weight was measured as in Example 3. The results were $Mw=2.5\times10^4$, $Mn=2.9\times10^3$ and $Mw/Mn=8.6$.

EXAMPLE 6

| | |
|---|---|
| Styrene | 70 parts |
| n-butyl methacrylate | 30 parts |
| Benzoyl peroxide | 1 part |
| Carbon black | 5 parts |
| Low molecular weight polypropylene "Viscol 550 P" | 5 parts |

A composition for polymerization in which the carbon black was satisfactorily dispersed was prepared from the above formulation as in Example 1. This composition for polymerization was added to aqueous solution of 1.2 wt% of polyvinyl alcohol and the mixture was agitated for 30 sec by a highspeed shearing mixer driven at a rate of 3000 r.p.m. to obtain a suspension with the above composition for polymerization split and dispersed in fine particles. This suspension was put into a 3-mouthed flask and after the replacement of the gaseous phase with nitrogen gas it was heated and kept at 80° C. for 10 hours for the completion of the polymerization reaction. After cooling, the reaction product was repeatedly dehydrated and rinsed, and then dried to directly prepare the Toner Sample 6, which was fine solid particles whose mean particle size was approx. 12$\mu$.

The same offset and copy tests as in Example 1 were conducted but for the use of Toner Sample 6. The results were as favorable as in Example 1.

EXAMPLE 7

The Toner Sample 7 was prepared just in the same manner as in Example 6 but for the use of a composition for polymerization that was prepared by adding 0.5 parts of divinyl benzene as a cross-linking agent to the formulation given in Example 6.

The same offset and copy tests as in Example 1 were conducted but for the use of Toner Sample 7. The results were as favorable as in Example 3. For the polymer constituent of this toner, molecular weight was measured as in Example 3. The results were $Mw=30\times10^4$, $Mn=1.8\times10^4$ and $Mw/Mn=16.7$.

EXAMPLE 8

| | |
|---|---|
| Styrene | 70 parts |
| n-butyl methacrylate | 30 parts |
| Benzoyl peroxide | 1 part |
| Low molecular weight polyethylene "6A" | 5 parts |

The above compounds were fully suspended to prepare the composition for polymerization. This composition was introduced into a 1-liter 3-mouthed flask filled with distilled water containing 0.6 wt% of polyvinyl alcohol. After mixing for suspension and dispersion, the gaseous phase was replaced with nitrogen gas and the reaction mixture was heated and kept at 80° C. for 10 hours to complete the polymerization reaction. After cooling, the reaction product was repeatedly dehydrated and rinsed, and finally dried to give a solid material in a form of coarse particles. After addition of 5 parts of carbon black, the product was fused and kneaded to form a lump, which was crushed and pulverized to prepare the Toner Sample 8 whose mean particle size was 13 to 15$\mu$.

The same offset and copy tests as in Example 1 were conducted but for the use of Toner Sample 8. The results were as favorable as in Example 1.

COMPARATIVE EXAMPLE 1

The Comparative Toner Sample 1 was prepared in the same manner as in Example 1 but for the use of a composition for polymerization that was equivalent to the formulation given in Example 1 but for the removal of the anti-offset agent or low molecular weight polyethylene.

Using this Comparative Toner Sample 1, developer was prepared by the same method as in Example 1 and the same offset test as in Example 1 was conducted therewith. When the temperature of the fixing roller was raised to 140° C., remarkable soiling due to the offset phenomenon was already detected and further the exhibited fixing performance was unsatisfactory and far beyond any practical use.

COMPARATIVE EXAMPLE 2

The Comparative Toner Sample 2 was prepared in the same manner as in Example 2 but for the removal of the anti-offset agent or low molecular weight polypropylene "Viscol 550 P" from the formulation given in Example 2.

The same offset test as in Example 1 was conducted but for the use of this Comparative Toner Sample 2. When the temperature of the fixing roller was raised to 120° C., remarkable soiling due to the offset phenomenon was already detected and practically no fixed copy image was available.

COMPARATIVE EXAMPLE 3

The monomer constituent of the composition for polymerization in Example 1 was independently copolymerized to give styrene/n-butyl methacrylate copolymer. After addition of 5 parts of carbon black and 20 parts of low molecular weight polyethylene, the copolymer was fused and kneaded to give a lump, which was crushed and pulverized to a mean particle size of 13 to 15$\mu$ for the preparation of the Comparative Toner Sample 3.

The same offset test as in Example 1 was conducted but for the use of this Comparative Toner Sample 3. When the temperature of the fixing roller was raised to 200° C., a slight sign of soiling due to the offset phenomenon was detected, the test result being more favorable than in case of the Comparative Toner Sample 1. However, in the same copy test as in Example 1, the fluidity of the developer was found low with images reproduced in a low density and further after 15000 copies there was remarkable soiling due to the offset phenomenon, namely, the fixing roller got soiled heavily and the photoconductor was also found soiled due to toner filming.

To confirm the effect of various anti-offset agents, toner was prepared from the formulation given in Example 3 but without adding the anti-offset agent low molecular weight polyethylene or replacing it with other anti-offset agents. With various kinds of toner thus made available as well as Toner Sample 3, the lowest temperature "t" at which the offset phenomenon appeared was checked. The results are given in the following table:

TABLE

| Type and name of anti-offset agent | | t (°C.) |
|---|---|---|
| Polyalkylene | Low molecular weight polyethylene | over 240 |
| Metal salt of fatty acid | Zinc stearate | 220 |
| Paraffin wax | Synthetic paraffin | 220 |
| Ester of fatty acid | Myricyl palmitate | 220 |
| Partially saponified ester of fatty acid | Partially saponified ester of montanic acid | over 240 |
| Higher fatty acid | Montanic acid | 240 |
| Higher alcohol | Myricyl alcohol | 215 |
| Ester of polyalcohol | Stearic acid glyceride | 215 |
| Fatty acid amide | Ethylenebisstearamide | 210 |
| None | — | 160 |

We claim:

1. A method for manufacturing toner for electrophotography which comprises polymerizing a monomer to give a polymer constituent of said toner in the presence of a coloring agent and an anti-offset agent, said anti-offset agent selected from the group consisting of
   (a) polyolefins having a weight average molecular weight between 1000 and 45,000,
   (b) metal salts of fatty acids,
   (c) esters of fatty acids,
   (d) partially saponified esters of fatty acids,
   (e) higher fatty acids,
   (f) higher alcohols,
   (g) paraffin wax,
   (h) esters of polyalcohols,
   (i) fatty acid amides,
   (j) silicon varnish,
   (k) oligomers of stearylacrylate, and
   (l) oligomers of copolymers containing stearylacrylate, wherein said polymer constituent is a homopolymer or copolymer of one or more of the monomers selected from the classes of
   styrenes,
   ethylenically unsaturated mono olefins,
   vinyl halides,
   vinyl esters,
   esters of $\alpha$-methylene aliphatic monocarboxylic acids,
   acrylics,
   methacrylics,
   vinyl ethers,
   vinyl ketones,
   N-vinyl compounds,
   vinyl naphthalenes, and
   diolefins or condensation polymers of
   (I) polyalcohols with polycarboxylic acids or
   (II) polyamines with polycarboxylic acids.

2. The method of claim 1 wherein said polymer constituent is a copolymer of monomers selected from styrenes, methacrylates, maleic acid, terephthalic acids, and diolefins.

3. The method of claim 1 wherein said polymer constituent is selected from styrene/n-butylmethacrylate, maleic acid/terephthalic acid and styrene/butadiene copolymers.

4. A method according to claim 1, wherein said polymerization step is effected in the presence of a cross-linking agent.

5. A method according to claim 1, wherein said polymerization process is effected in the presence of a polymer.

6. The method of claim 4 wherein said cross linking agent is selected from aromatic divinyl compounds, diethylenic carboxylic acid esters, divinyl compounds, and trivinyl compounds.

7. The method of claim 4 wherein said cross linking agent is selected from divinyl benzene, divinyl naphthalene, diethylene glycol methacrylate, diethylene glycol acrylate, triethylene glycol methacrylate, trimethanol propane trimethacrylate, aryl methacrylate, t-butylaminoethyl methacrylate, tetraethylene glycol dimethacrylate, 1,3-butanediol dimethacrylate, N,N-divinyl aniline, divinyl ether, divinyl sulfide, and divinyl sulfone.

8. The method of claim 4 wherein said cross linking agent is selected from a polyalcohol having at least three hydroxyl groups, a polyamine having at least three amino groups and a polycarboxylic acid having at least three carboxylic acid groups.

9. The method of claim 4 wherein said cross linking agent is selected from glycerine, trimethanol propane, pentaerythritol, 1,2,3-triamino propane, diethylene triamine, 3,3-diamino benzidine, trimellitic acid and pyromellitic acid.

10. The toner composition comprising the product of the process of claim 1.

* * * * *